US007093453B2

(12) United States Patent
Asan et al.

(10) Patent No.: US 7,093,453 B2
(45) Date of Patent: Aug. 22, 2006

(54) REFRIGERATOR WITH COLD AIR CIRCULATION

(75) Inventors: Zeki Asan, Corlu/Tekirdag (TR); Cetin Celik, Cerkezöy/Tekirdag (TR); Alexander Görz, Aalen-Ebnat (DE); Hans-Reinhart Janssen, Giengen (DE); Ibrahim Kabasakal, Corlu/Tekirdag (TR); Werner Reichel, Heidenheim (DE); Manfred Strobel, Langenau (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/792,985

(22) Filed: Mar. 4, 2004

(65) Prior Publication Data

US 2005/0011219 A1 Jan. 20, 2005

Related U.S. Application Data

(63) Continuation of application No. PCT/EP02/09696, filed on Aug. 30, 2002.

(30) Foreign Application Priority Data

Sep. 4, 2001 (DE) ..... 101 43 242

(51) Int. Cl.
*F25D 17/04* (2006.01)

(52) U.S. Cl. ..... 62/186; 62/407

(58) Field of Classification Search ..... 62/186, 62/407, 411, 414, 440, 443, 447, 449, 409
See application file for complete search history.

(56) References Cited

U.S. PATENT DOCUMENTS 3,709,576 A * 1/1973 Lemoine ..... 312/321.5
4,671,074 A * 6/1987 Gostelow et al. ..... 62/186
5,100,213 A * 3/1992 Vandarakis et al. ..... 312/405
5,187,941 A * 2/1993 Tershak et al. ..... 62/89
5,199,273 A * 4/1993 Silva et al. ..... 62/298
5,388,418 A * 2/1995 Martin et al. ..... 62/131
5,425,245 A * 6/1995 Martin et al. ..... 62/187
5,501,084 A * 3/1996 Chang et al. ..... 62/264
5,527,105 A * 6/1996 Riach, Jr. ..... 312/406
5,588,731 A * 12/1996 Schmidt et al. ..... 312/405
5,687,580 A * 11/1997 Jeong et al. ..... 62/186
5,896,752 A * 4/1999 Park ..... 62/186
5,927,095 A * 7/1999 Lee ..... 62/275
5,960,641 A * 10/1999 Kim et al. ..... 62/407
5,996,370 A * 12/1999 Lee ..... 62/407
6,044,654 A 4/2000 Igari et al.
6,073,458 A 6/2000 Kim
6,539,729 B1 * 4/2003 Tupis et al. ..... 62/89

FOREIGN PATENT DOCUMENTS

EP 0 881 441 A2 12/1998
JP 07004821 A 1/1995
JP 200081268 A 3/2000

(Continued)

*Primary Examiner*—Mohammad M. Ali
(74) *Attorney, Agent, or Firm*—John T. Winburn; Russell W. Warnock; Craig J. Loest

(57) ABSTRACT

A refrigerating appliance has a heat-insulating housing, at least one door, and an interior cooling chamber enclosed by the housing and the door. The chamber is cooled by the circulation of cooling air. A flow channel for the cooling air is mounted at the door. The flow channel is formed with outlets for the passage of the cooling air from the channel into the inner chamber and also to a plane of the door.

15 Claims, 4 Drawing Sheets

FOREIGN PATENT DOCUMENTS

| | | | | |
|---|---|---|---|---|
| JP | 2000121230 | A | | 4/2000 |
| JP | 2000180044 | A | * | 6/2000 |
| JP | 02001108351 | A | * | 4/2001 |
| KR | 2003018831 | A | * | 3/2003 |
| KR | 2003018832 | A | * | 3/2003 |

* cited by examiner

Fig. 5
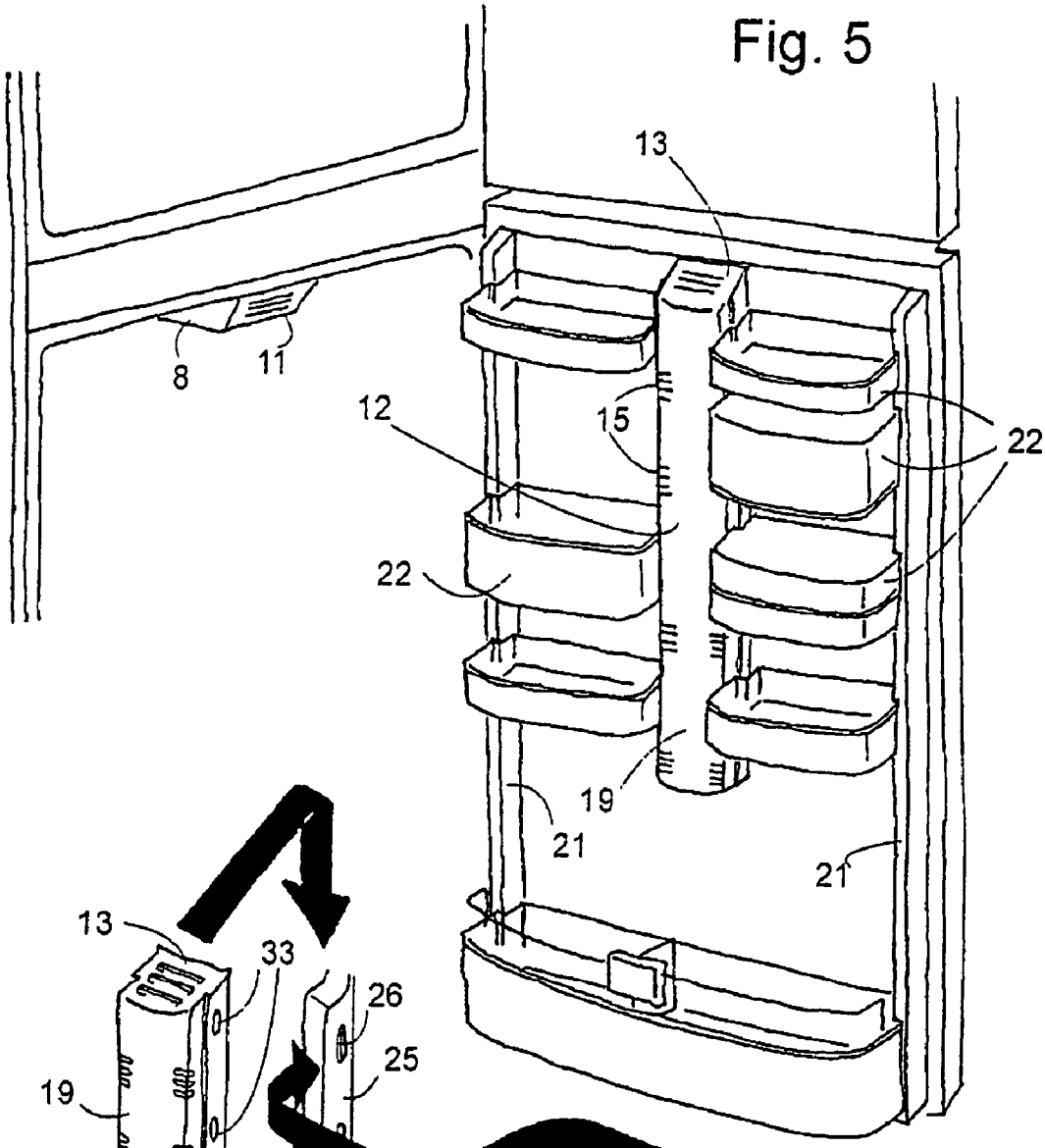
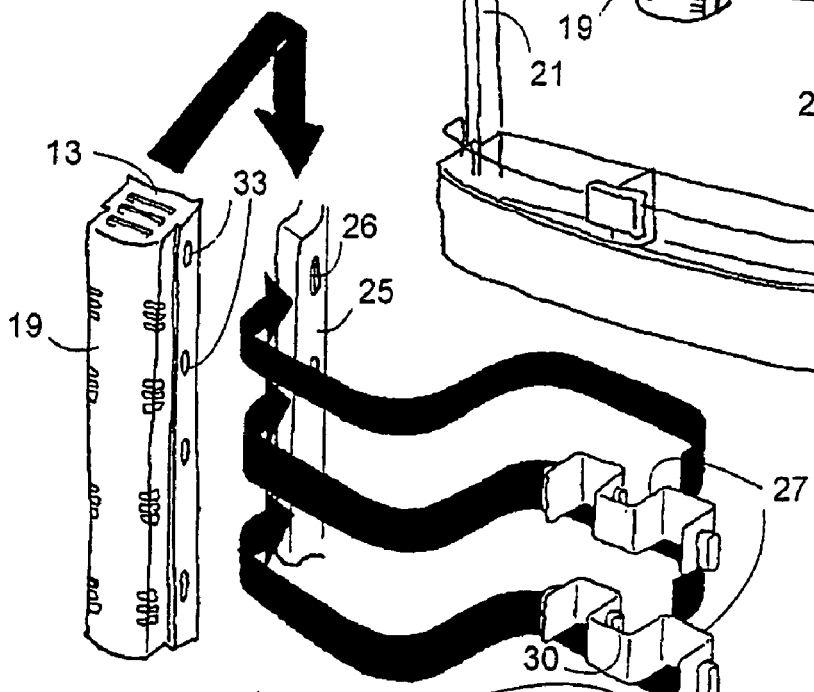
Fig. 7
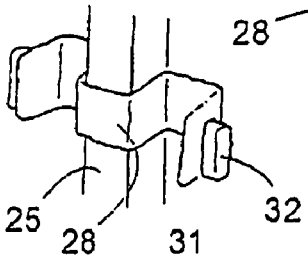
Fig .6

REFRIGERATOR WITH COLD AIR CIRCULATION

CROSS-REFERENCE TO RELATED APPLICATION

This application is a continuation, under 35 U.S.C. § 120, of copending international application No. PCT/EP02/09696, filed Aug. 30, 2002, which designated the United States; this application also claims the priority, under 35 U.S.C. § 119, of German patent application No. 101 43 242.9, filed Sep. 4, 2001; the prior applications are herewith incorporated by reference in their entirety.

BACKGROUND OF THE INVENTION

Field of the Invention

The invention relates to a refrigerator with an interior region that is cooled by means of the circulation of cold air. The refrigerator has a thermally insulating housing, at least one door, and a cooling space enclosed by the housing and the door and cooled by a cold air circulation Refrigerators of this type, known as NoFrost refrigerators, have become known in the art. In general, they have a low temperature generator, for instance an evaporator, which is disposed outside the interior space and which is force ventilated by a ventilator. Air that has been aspirated out from the interior is conducted past the evaporator in order to cool it, dry it by condensation, and conduct the resulting dry air back into the interior. There can be flow channels provided in the interior, which comprise air exit holes at various locations in order purposefully to distribute the cold air in the interior and to achieve a desired temperature distribution.

In order to achieve a homogenous temperature distribution in the cooling chamber, refrigerators have been suggested in which cold air is discharged in the upper region of the interior. From there, the cold air flows downward in the interior space owing to its relatively higher density, cooling the lower region as well before being sucked out again. But it has proven to be difficult to cool the lower region of a refrigerator satisfactorily with such a configuration, because the flow of cold air that is released in the upper region of the interior space is deflected at the bottoms of several compartments and at food holders that are mounted on the inside surface of the door before the air finally reaches the bottom region.

Another problem is associated with the cooling of the door region of a refrigerator effectively, because the thermal insulation is generally less effective there than at the sealed walls of the housing, and moreover, because warm air enters every time the door is opened. A particularly problematic intrusion of warm air occurs at the interface between the door and the housing which is produced by the door gasket in contact with the refrigerator housing. An attempt to counteract the problem is suggested in European patent EP 0 532 870 B1, where a fan is provided in the upper region of the rear wall of a refrigerator. The fan directs a cool airflow against the door. But that suggestion can only help locally in the upper region of the door.

SUMMARY OF THE INVENTION

It is accordingly an object of the invention to provide a refrigerator with cold air circulation which overcomes the above-mentioned disadvantages of the heretofore-known devices and methods of this general type and which improves the distribution of cold air in the interior space of the refrigerator in order to improve the temperature distribution inside the interior space and the cooling rate of the refrigerated goods stored therein.

With the foregoing and other objects in view there is provided, in accordance with the invention, a refrigerator, comprising:

a thermally insulating housing and at least one door bounding an interior space cooled by cold air circulation;

a flow channel for cold air disposed at said door, said flow channel having exit openings formed therein for feeding cold air from said flow channel to said interior space and to a plane of said door.

In other words, the object of the invention is achieved by arranging a flow channel for the cold air at the door itself, and by forming the flow channel with exit openings for the outflow of cold air from the channel to the plane of the door and/or into the interior space.

In order to be able to propel the flow of cold air in the channel while consuming an optimally small amount of energy, the flow channel advantageously extends down from a starting point at the top edge of the door.

In order to guarantee that cold air also reaches the lower region of the refrigerator in the necessary amount, the flow channel can extend substantially along the entire height of the door.

A supply channel for supplying cold air to the flow channel at the door is advantageously led along the ceiling of the interior space. The junction between the supply channel and the flow channel itself represents an exit opening for the cold air which supplies the upper region of the interior space. This obviates the need for a seal in the region of the junction, so that the requirements with respect to the mounting precision of the flow channel in relation to the supply channel are easy to meet.

In order to create a constructional configuration that is equally suitable for doors that open to the right or to the left—i.e. a construction allowing for the door opening direction to be easily changed afterward—the flow channel advantageously extends along the vertical center line of the door.

The inner surface of the door to the right and left of the flow channel can be used for mounting food holders.

Bearing elements for bearing the food holders are thus advantageously provided at the flow channel.

There are known refrigerators in which the inner surface of the door is divided by a vertical beam, so that food holders can be mounted to the right and left of the rib at different levels at bearing elements of the rib. A door of this type can also be used for the present invention, in that the flow channel is mounted at this rib. The flow channel can be formed substantially by an elongated hood that covers the rib and is fastened to its bearing elements. That way, a uniform inner door forming the inner surface of the door can be utilized for refrigerators of various designs and constructions. This represents a substantial logistical simplification.

In order to fasten the hood on the bearing elements of the rib, clamps with a center portion and two lateral wings can be utilized, the center portion of which engages the bearing elements of the ribs, while the lateral wings bear the hood.

Other features which are considered as characteristic for the invention are set forth in the appended claims.

Although the invention is illustrated and described herein as embodied in a Refrigerator With Cold Air Circulation, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 5 is a perspective partial view of the refrigerator according to the invention with the door open;

FIG. 6 is a piece of a vertical rib of the door of FIG. 5 with a clamp of the flow channel fastened there; and FIG. 7 is an exploded view representing the assembling of the flow channel on the inner surface of the door according to FIG. 5.

DESCRIPTION OF THE PREFERRED EMBODIMENTS

Figure 1:
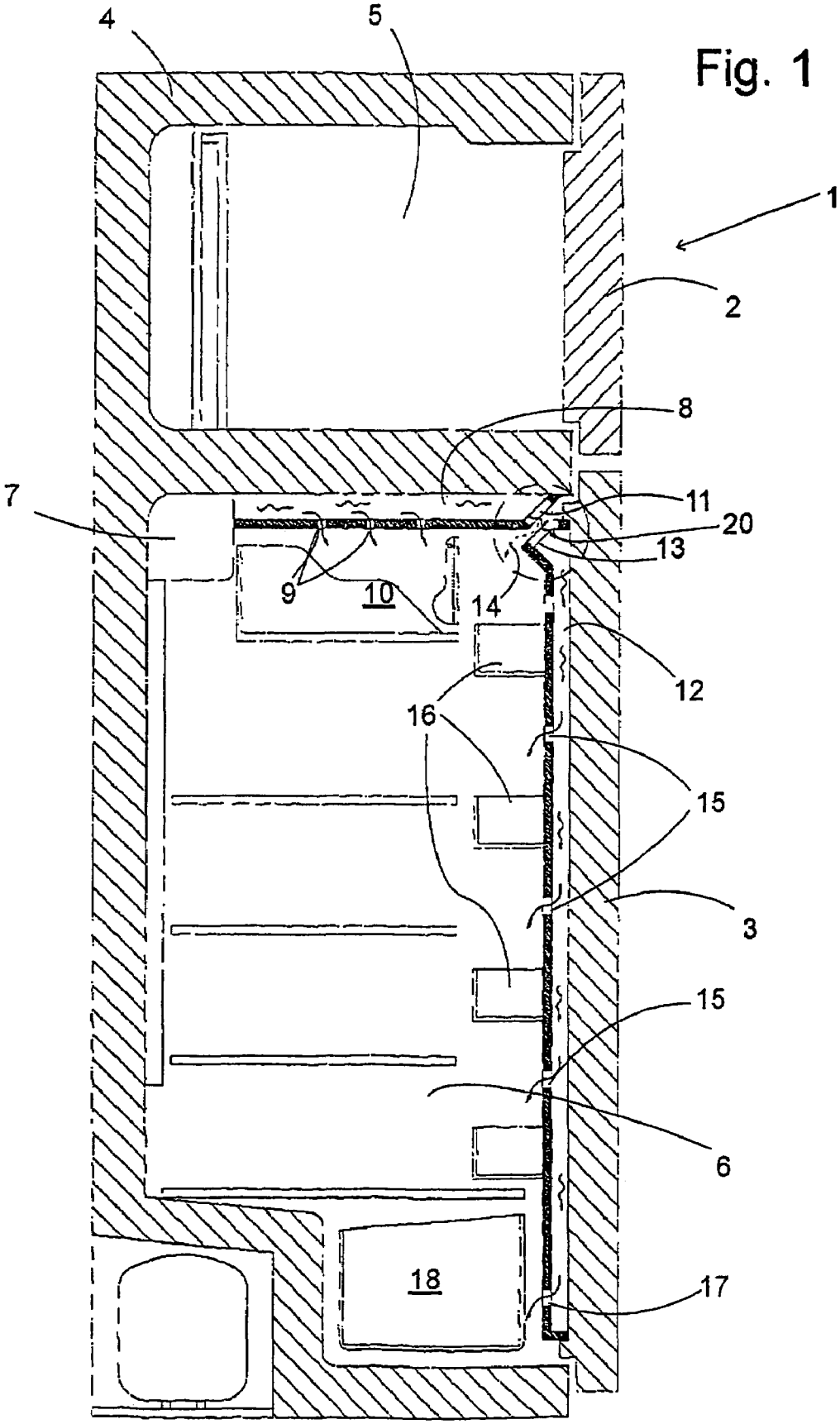
FIG. 1 is a vertical section through a The refrigerator according to the invention.

Referring now to the figures of the drawing in detail and first, particularly, to FIG. 1 thereof, there is shown an exemplary embodiment of a novel refrigerator, that is, an forced flow refrigerator with improved cooling air distribution. The vertical section represents a household frost-free or NoFrost refrigerator 1 with two interior spaces 5, 6 that are provided with separate doors 2, 3 and disposed in a thermally insulating housing 4, the top space 5 being constructed as a freezer, and the bottom space 6 being constructed as a refrigeration chamber. It will be understood that the term refrigerator is used in a broad sense in that the invention encompasses refrigeration devices with a single interior chamber or a refrigerator that is not a frost-free refrigerator.

A fan that is disposed in a chamber 7 in an upper corner of the interior space 6 sucks air from the interior space 6 via an evaporator that extends along a wall of the interior space but which is not represented in the Figure, where the air is cooled and dried, and expels the air into a supply channel that extends along the top of the interior space from the chamber 7 toward the upper edge of the door 3. The supply channel 8 comprises a number of air exit openings 9, which charge a special cold chamber 10 that is separate from the rest of the interior space 6, in which a temperature is maintained between the normal cold temperature otherwise prevailing in the interior space 6 and the temperature of the freezer compartment 5.

A through opening 11 whose cross-section is larger than that of the air exit openings 9 of the supply channel 8 is formed at an oblique surface at a front end, which faces the door 3, of the supply channel 8. Through the through opening 11, a majority of the cold air that is expelled by the fan reaches a flow channel 12 that extends along the center line of the door 3 down to its bottom end. Situated opposite the through opening 11 of the supply channel 8 at a small distance therefrom and parallel thereto is an oblique surface 13 with a whole-surface entry opening 20 of the flow channel 12. Through the gap so formed, a weak flow of cold air, represented by dotted arrow 14, can escape into the interior space 6. The intensity of this flow depends on the flow relations at the gap in each specific case; for instance, it is imaginable that, if the flow rate of the cold air is low, and the temperature is extremely low compared to the interior space 6, the inverse chimney effect of the downward flowing air in the flow channel 12 could become so strong that the direction of the flow 14 could even reverse itself in the region of the gap. A similar effect can be achieved by a radiation pump effect, provided that the openings 11, 20 are shaped accordingly.

Air exit openings 15 are represented at the flow channel 12 at different heights. In the Figure, they are positioned above food holders 16 that are mounted at the interior surface of the door. In order to be able to freely place these food holders 16 at any height without interfering with the cold airflow, it can be advantageous to arrange the air exit openings 15 at a closer vertical stagger than is represented in the figure, for instance at intervals of a few centimeters, and to block unneeded exit openings with a plate (not represented), which can be part of a food holder 16.

The lowest air exit opening, referenced 17, is at the level of a drawer 18 around whose bottom and rear side the cold airflow can be blown. Not only is an effective and uniform cooling of the interior space 6 along its entire height guaranteed by the leading of the flow channel 12 down to the level of this compartment, but also a homogenous cooling of the inside of the door, along with the food holders 16 that are arranged there and the food that has been placed therein, is also produced by the configuration and construction of the air exit openings 15.

Figure 2:
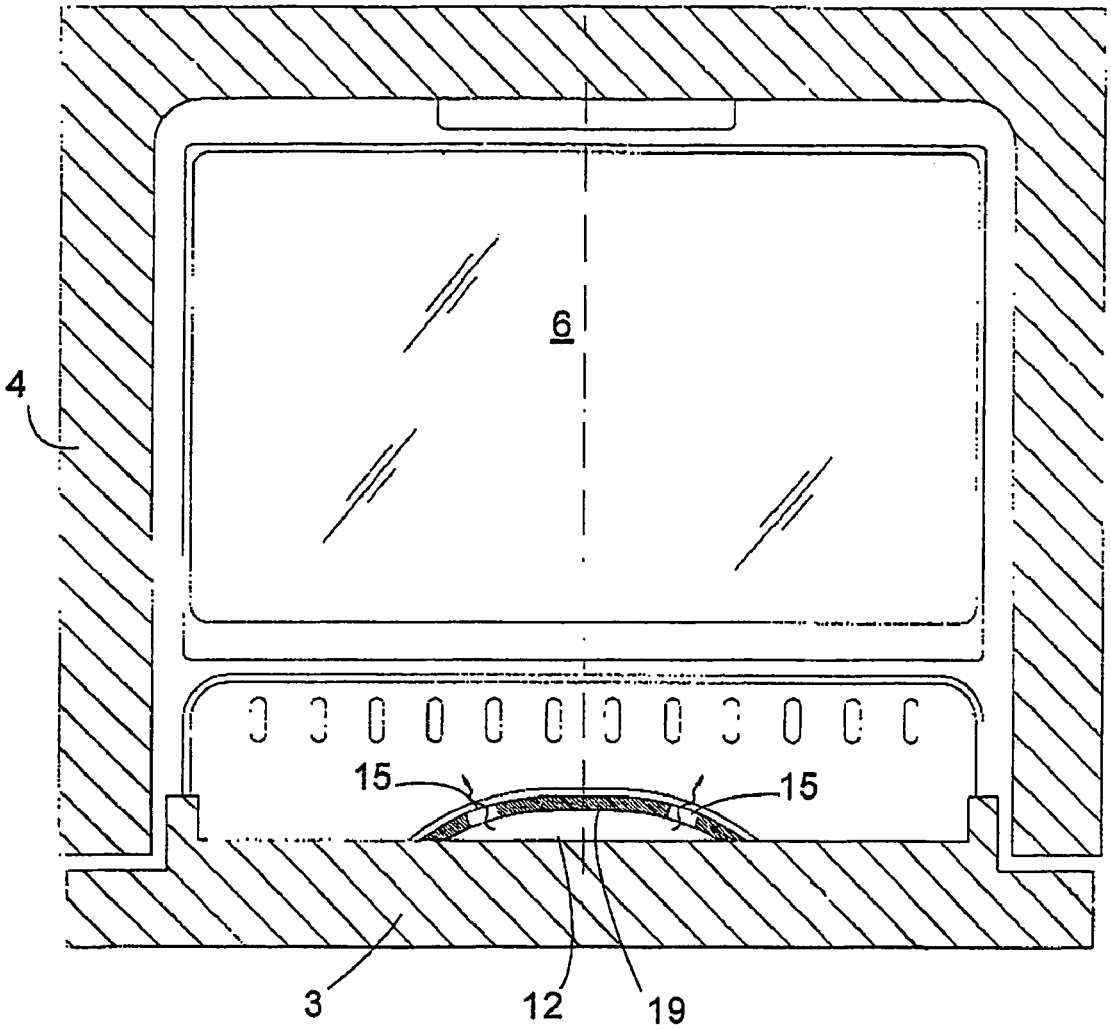
FIG. 2 is a horizontal section through the refrigerator of FIG. 1.

FIG. 2 represents a horizontal section through the refrigerator of FIG. 1 at the height level of one of the exit openings 15. It is clear that the flow channel 12 is bounded on one side by the interior wall of the door 12, which is usually formed by deep-drawing a plastic blank, and on the other side by an elongated flat hood 19 that extends vertically on both sides of the dotted center line of the door 3 in symmetrical fashion. According to this construction, the food holders 16 extend over the entire width of the door, with a central recess corresponding to the contour of the hood 19.

Figure 3:
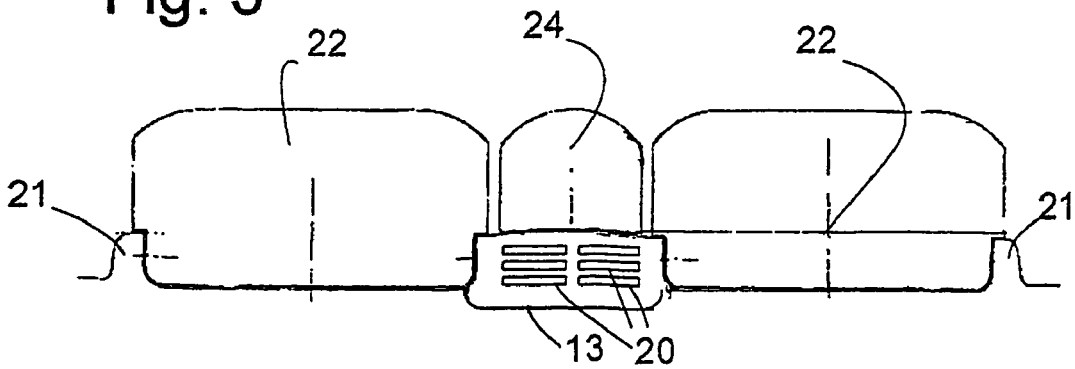
FIG. 3 is a top view of a refrigerator door with a flow channel mounted there according to a modified development of the invention.

FIG. 3 is a plan view of the interior part of a refrigerator door according to a second development of the invention. At the inner wall, two vertical beams 21 are formed laterally, which comprise carrier projections or recesses. (not represented) that are provided in order to hang food holders 22 comprising corresponding recesses or projections. Extending centrally between the two beams 21 is the hood 19 of the flow channel 12, of which only the top oblique surface 13 with the entry openings 20 are visible in the plan view of FIG. 3. The hood 19 is also provided with bearing projections or recesses at which the food holders 22 are mountable, though these are not represented.

Figure 4:
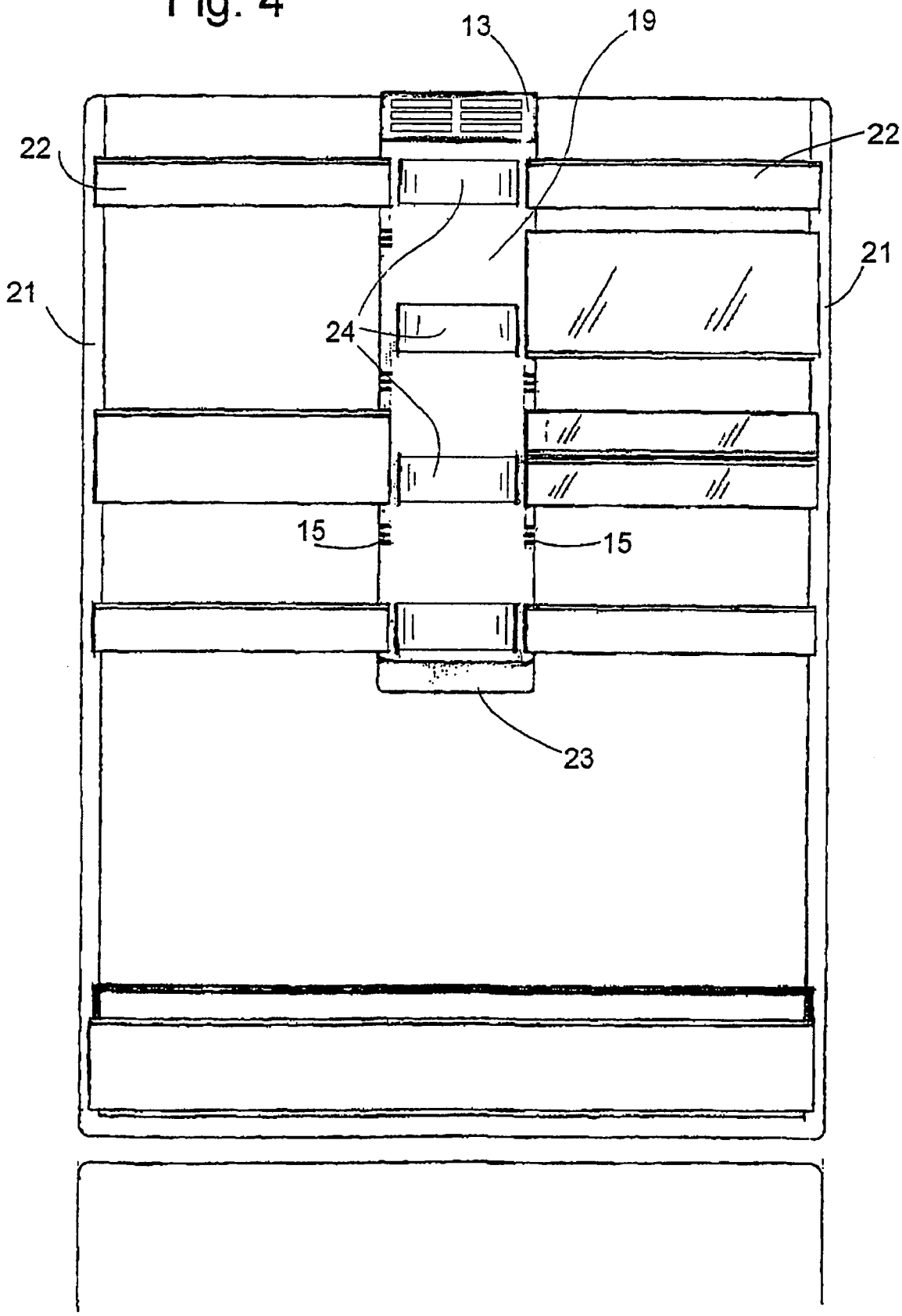
FIG. 4 is a frontal view of the interior surface of the refrigerator door of FIG. 3.

FIG. 4 is a front view of the inner surface of the door from FIG. 3. The hood 19 extends only over the upper two-thirds of the height of the door 3 and is sealed by an oblique surface at its bottom end. Air exit openings 15 are disposed in the region of the vertically oriented corners of the hood 19 and generate a cold airflow that is oriented toward the food holders 22 and into the middle of the interior space 6. A plurality of small-format food holders 24 are configured on the front side of the hood 19 at different heights.

FIG. 5 is a partial perspective view of a The refrigerator according to the invention, with a flow channel 12 that extends down along the inside surface of the door 2 from its top edge over most of its height. In this variant, the depth of the flow channel 12 is only marginally smaller than that of the surrounding rack shelves or food holders 22. The small-format holders 24 are omitted in this case. A vertical beam 25 extends along the center line of the door under the hood 19 of the flow channel and is covered thereby, said beam being represented in the exploded view in FIG. 7 and the partial view in FIG. 6. The beam 25 comprises bearing elements in the form of locking depressions 26 at regular intervals, which can serve, in conjunction with corresponding depressions on the lateral ribs 21 of the door, for hanging food holders in a conventional refrigerator without the flow channel 12. In the context of the present invention, however, they are provided for the hanging of clamps 27 with an approximately W-shaped cross-section.

The clamps 27 represented in perspective in FIG. 7 comprise a center portion 28 with two opposing flanks 29, whose surfaces facing one another each bear a lock projection 30 corresponding to a lock depression 26. The clamps consist of a flexible material such as steel, so that the center portion 28 can be widened in order to clinch it over the rib 25 and lock the projections 30 in depressions 26 on opposite sides of the rib. The free ends of the flanks 29 each bear L-shaped wings 31, which in turn bear respective lock projections 32 on their mutually averted exterior surfaces. These lock projections 32 are provided in order to engage in openings 33 of the hood 19 from inside out and thereby permanently join the hood 19 to the rib 25.

The length of the projections 32 is advantageously larger than the thickness of the wall of the hood 19, so that the projections 32 protrude through the openings 33 laterally after the hood 19 has been assembled. That way, they can simultaneously serve as suspension points for hanging the food holders 22 that are disposed to the side of the hood 19.

We claim:

1. A refrigerator, comprising:

a thermally insulating housing and at least one door bounding an interior space cooled by cold air circulation;

at least one food holder located on said door;

a flow channel for cold air disposed at said door, said flow channel having exit openings formed therein for feeding cold air from said flow channel to said interior space and to a plane of said door, said flow channel including a plurality of air exit openings generating cold airflows separately into said interior space and into said food holder; and a vertical rib disposed on an inner surface of said door and locking elements on said vertical rib, and wherein said flow channel comprises an elongated hood fastened to said locking elements, and covers said vertical rib.

2. The refrigerator according to claim 1, wherein said flow channel extends downwardly from a starting point at an upper edge of said door.

3. The refrigerator according to claim 1, wherein said flow channel extends substantially over an entire height of said door.

4. The refrigerator according to claim 1, which further comprises a supply channel extending along a ceiling of said interior space and connected to said flow channel at said door for supplying cold air to said flow channel.

5. The refrigerator according to claim 1, wherein said door has a defined vertical center line and said flow channel extends along said vertical center line of said door.

6. The refrigerator according to claim 1, including a plurality of food holders disposed on an interior surface of said door laterally of said flow channel.

7. The refrigerator according to claim 6, wherein said flow channel carries bearing elements for fastening said food holders on said flow channel.

8. The refrigerator according to claim 1, wherein said flow channel comprises retaining elements on a front side thereof for detachably fastening food holders thereon.

9. The refrigerator according to claim 1, including a plurality of food holders disposed on an interior surface of said door, said flow channel extends downwardly from a starting point at an upper edge of said door, said door has a defined substantially vertical center line and said flow channel extends along said vertical center line of said door.

10. The refrigerator according to claim 9, wherein said flow channel extends substantially over an entire height of said door.

11. The refrigerator according to claim 9, further including a supply channel extending along a ceiling of said interior space and coupled to said flow channel at said door for supplying cold air to said flow channel.

12. The refrigerator according to claim 9, including said plurality of food holders disposed on said interior surface of said door laterally of said flow channel.

13. The refrigerator according to claim 12, including said flow channel carries bearing elements for fastening said food holders on said flow channel.

14. A refrigerator comprising:

a thermally insulating housing and at least one door bounding an interior space cooled by cold air circulation;

a flow channel for cold air disposed at said door, said flow channel having exit openings formed therein for feeding cold air from said flow channel to said interior space and to a plane of said door; and a vertical rib disposed on an inner surface of said door and locking elements on said vertical rib, and wherein said flow channel comprises an elongated hood fastened to said locking elements, and covers said vertical rib.

15. The refrigerator according to claim 14, which comprises clamps fastening said hood to said vertical rib, said clamps having center portions locked on said bearing elements of said vertical rib and two lateral wings bearing said hood.

* * * * *